US010328687B2

(12) United States Patent
Birger et al.

(10) Patent No.: US 10,328,687 B2
(45) Date of Patent: Jun. 25, 2019

(54) PRINTER DRYER WITH A PLURALITY OF DRYING UNITS

(71) Applicant: HP SCITEX LTD., Netanya (IL)

(72) Inventors: Semion Birger, Netanya (IL); Alex Veis, Kadima (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/994,441

(22) Filed: May 31, 2018

(65) Prior Publication Data

US 2019/0030880 A1 Jan. 31, 2019

(30) Foreign Application Priority Data

Jul. 26, 2017 (EP) ..... 17183369

(51) Int. Cl.
*B41F 23/04* (2006.01)
*B41J 11/00* (2006.01)
*H05B 33/08* (2006.01)

(52) U.S. Cl.
CPC ..... *B41F 23/0453* (2013.01); *B41J 11/002* (2013.01); *H05B 33/0806* (2013.01)

(58) Field of Classification Search
CPC .. B41J 11/002; B41F 23/0453; B41F 23/0486
USPC ..... 347/101, 102, 104
See application file for complete search history.

(56) References Cited

U.S. PATENT DOCUMENTS 8,272,729 B2 9/2012 Caiger et al.
8,699,921 B2 4/2014 Petermann
8,721,035 B2 * 5/2014 Ooishi ..... B41J 2/2114 347/15
9,839,824 B2 1/2017 Masuda et al.
2008/0035132 A1 2/2008 Katoh
(Continued)

FOREIGN PATENT DOCUMENTS

EP 3124261 2/2017

OTHER PUBLICATIONS

Revolutionary, Energy-saving LED UV Drying Option for ROLAND 700 Evolution, < http://www.manrolandsheetfed.com/en-GB/news/584/revolutionary-energy-saving-led-uv-drying-option-for-roland-700-evolution >.

*Primary Examiner* — An H Do
(74) *Attorney, Agent, or Firm* — HP Inc. Patent Department

(57) ABSTRACT

A printer dryer device includes a first drying unit, wherein the first drying unit includes a first plurality of energy-emitting elements to dry a printing substance on a printing medium, wherein the first plurality of energy-emitting elements are electrically connected in series in the first drying unit. The printer dryer device further includes a second drying unit, wherein the second drying unit includes a second plurality of energy-emitting elements to dry the printing substance on the printing medium, wherein the second drying unit is arranged downstream from the first drying unit in a medium transport direction of the printing medium, and wherein the second plurality of energy-emitting elements are electrically connected in series in the second drying unit. At least one energy-emitting element among the second plurality of energy-emitting elements is not electrically connected in series to an energy-emitting element among the first plurality of energy-emitting elements.

15 Claims, 5 Drawing Sheets

(56) References Cited

U.S. PATENT DOCUMENTS

| | | | | |
|---|---|---|---|---|
| 2014/0210880 | A1 | 7/2014 | Edlitz et al. | |
| 2015/0239262 | A1 | 8/2015 | Masuda et al. | |
| 2017/0028707 | A1* | 2/2017 | Veis | B41J 11/002 |

* cited by examiner

PRINTER DRYER WITH A PLURALITY OF DRYING UNITS

BACKGROUND

The disclosure relates to a printer dryer device for drying printing substances on a printing medium, such as a printer dryer for drying an ink of an inkjet printer.

In print operations, liquid printing substances, such as inks, fixers, primers and coatings may be applied to a printing medium. The printing medium may then be dried, for example using hot air convection, infrared radiation dryers, or ultraviolet (UV) radiation dryers, or a combination of such drying techniques.

Ultraviolet curable inks may comprise polymers, oligomers, and photo initiators that are crosslinked in response to ultraviolet irradiation. Even though no significant evaporation takes place in the course of the UV irradiation and crosslinking, it is common to use the term "drying" when referring to the crosslinking of UV curable inks. These inks are very versatile, and can be printed on a large range of printing media, from paper and cardboard to plastics and even glass and ceramics.

A second type of inks are water-based inks, which are mainly used for printing on cardboard or paper. These prints can be made food-compliant, and hence can be employed to print on packages of food or beverages. Water-based inks may be dried by means of evaporation drying, such as by a combination of hot air convection and infrared or ultraviolet irradiation. They usually involve larger drying energy and/or drying times than UV curable inks.

BRIEF DESCRIPTION OF HE DRAWINGS

Examples will now be described with reference to the accompanying drawings, in which.

DESCRIPTION OF EXAMPLES

Examples of the invention as described in the disclosure with reference to the figures may allow to reduce the total voltage drop across the light-emitting elements in a series connection of the printer dryer device, by arranging the light-emitting elements in a plurality of drying units across a medium transport direction of the printer. The drying unit may be staggered along the medium transport direction to allow the printer dryer device to dry a printing substance across an extended length along the medium transport direction.

Figure 1:
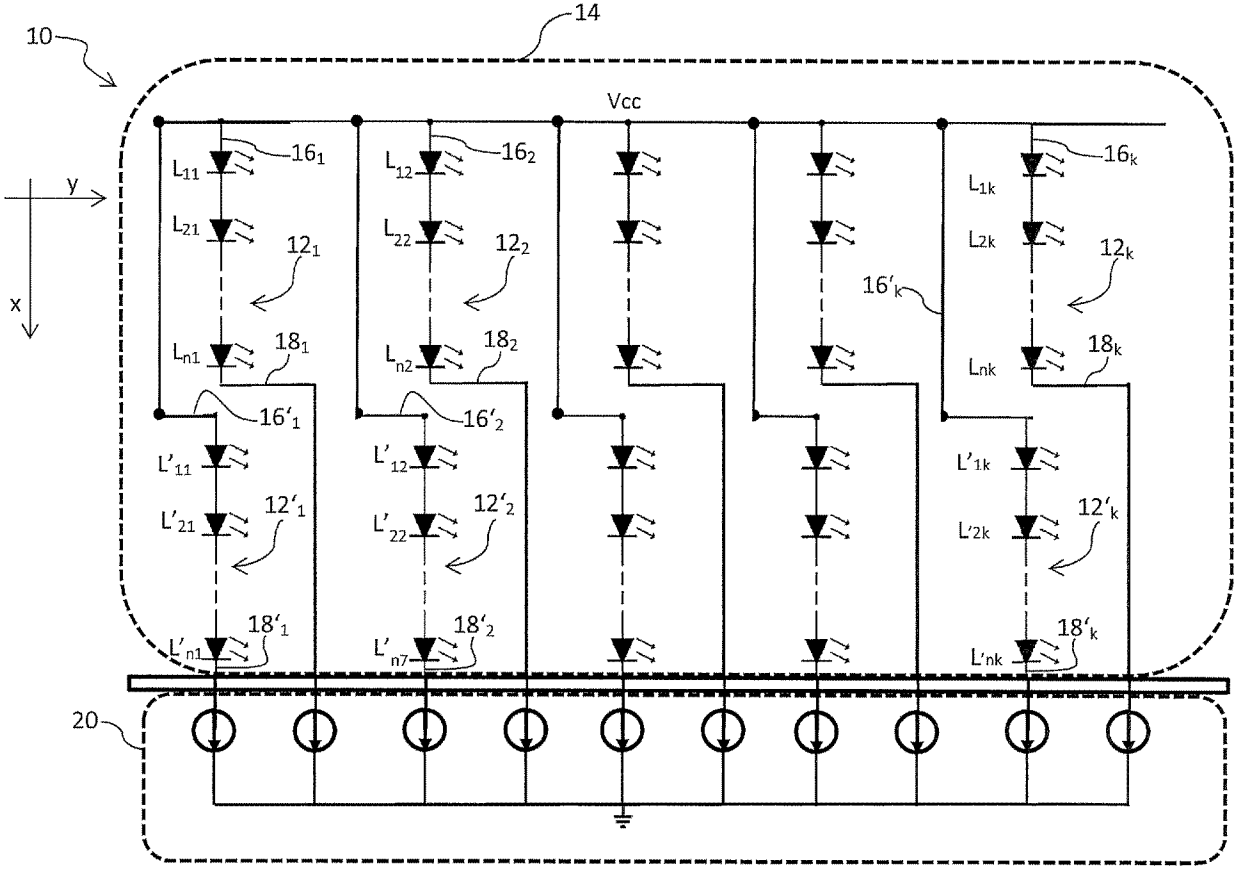
FIG. 1 is a schematic top view of a printer dryer device according to an example.

FIG. 1 shows a printer dryer device 10 according to an example in a schematic top view. A first drying unit $\mathbf{12}_1$ and a second drying unit $\mathbf{12'}_1$ are arranged on a substrate 14 of the printer dryer device 10 along a medium transport direction x of a printing device, such as an inkjet printer.

The first drying unit $\mathbf{12}_1$ comprises a plurality of n ultraviolet (UV) light-emitting diodes (LED) $L_{11}, \ldots, L_{n1}$ electrically connected in series and geometrically arranged along a row in the medium transport direction x. Each of the UV LEDs $L_{11}, \ldots, L_{n1}$ is adapted to emit ultraviolet irradiation, such as at a wavelength of 395 nm, to dry a printing substance on a printing medium that passes by the printer dryer device along the medium transport direction x. For instance, the UV LEDs $L_{11}, \ldots, L_{n1}$ may dry a water-based ink by means of evaporation drying, or may cure an ultraviolet curable ink.

The second drying unit $\mathbf{12'}_1$ generally corresponds in technical design and functionality to the first drying unit $\mathbf{12}_1$, and comprises a plurality of ultraviolet light-emitting diodes $L'_{11}, \ldots, L'_{n1}$ connected in series in a row along the medium transport direction x. In the example of FIG. 1, the first drying unit $\mathbf{12}_1$ and the second drying unit $\mathbf{12'}_1$ comprise an equal number n of light-emitting diodes. However, in other examples the number of light-emitting diodes in the first drying unit $\mathbf{12}_1$ may be larger or smaller than the number of light-emitting diodes in the second drying unit $\mathbf{12'}_1$.

As can be further taken from FIG. 1, the printer dryer device 10 further comprises a first input line $\mathbf{16}_1$ connecting a first light-emitting element $L_{11}$ of the first drying unit $\mathbf{12}_1$ to a voltage supply $V_{cc}$, and a first output line $\mathbf{18}_1$ connecting a last light-emitting element $L_{n1}$ in the row of the first drying unit $\mathbf{12}_1$ to an electrical driver unit 20.

The first input line $\mathbf{16}_1$, the plurality of light-emitting elements $L_{11}, \ldots, L_{n1}$ arranged in this order on the substrate 14 along the medium transport direction x, and the first output line $\mathbf{18}_1$ together with the voltage supply $V_{cc}$ and the driver unit 20 together establish a driving circuit for the first drying unit $\mathbf{12}_1$. Given that the light-emitting elements $L_{11}, \ldots, L_{n1}$ are connected in series in the first drying unit $\mathbf{12}_1$, the total voltage drop along the first drying unit $\mathbf{12}_1$ corresponds to the sum of the voltage drops at each of the respective light-emitting diodes $L_{11}, \ldots, L_{n1}$ For instance, if the operating voltage drop at each light-emitting diode $L_{11}, \ldots, L_{n1}$ amounts to 3.5 V, the total voltage drop across the first drying unit $\mathbf{12}_1$ amounts to n×3.5 V.

The second drying unit $\mathbf{12'}_1$ downstream from the first drying unit $\mathbf{12}_1$ in the medium transport direction x is generally similar to the first drying unit $\mathbf{12}_1$. A second input line $\mathbf{16'}_1$ connects the first UV LED $L'_{11}$ in the series of light-emitting elements of the second drying unit $\mathbf{12'}_1$ to the voltage source $V_{cc}$, and a second output line $\mathbf{18'}_1$ connects the last light-emitting element $L'_{n1}$ at the opposite end of the second drying unit $\mathbf{12'}_1$ to the common driver unit 20. Hence, the first drying unit $\mathbf{12}_1$ and the second drying unit $\mathbf{12'}_1$ are electrically connected in parallel between the voltage source $V_{cc}$ and the driver unit 20.

In the configuration of FIG. 1, the light-emitting elements of the first drying unit $\mathbf{12}_1$ and the second drying unit $\mathbf{12'}_1$ are mutually aligned along the medium transport direction x. Together they form a long array of ultraviolet light-emitting elements arranged in a row along the medium transport direction x. Hence, a large number of light-emitting elements can be arranged along the medium transport direction x on the substrate 14 of the printer dryer device 10, which allows for a quick and efficient drying of the printing substance, such as evaporation drying of water-based inks. As can be further taken from the example of FIG. 1, the second drying unit $\mathbf{12'}_1$ is not electrically connected in series to the first drying unit $\mathbf{12}_1$. In particular, none of the UV LEDs $L'_{11}, \ldots, L'_{n1}$ of the second drying unit $\mathbf{12'}_1$ is connected in series to any of the UV LEDs $L_{11}, \ldots, L_{n1}$ of the first drying unit $\mathbf{12}_1$. Hence, the driving voltage that builds up along the length of the medium transport direction x can be limited compared to what could be achieved with a single series connection.

In an example, the UV LEDs may be spaced at a spacing of 2.5 mm each along the medium transport direction x. Assuming a voltage drop of 3.5 V at each UV LED and a driver unit 20 that can safely handle operating voltages up to 80 V, each of the first and second drying units $\mathbf{12}_1$, $\mathbf{12'}_1$ may comprise $$n = \left\lfloor \frac{80}{3.5} \right\rfloor = 22 \tag{1}$$

UV LEDs. This allows for an effective drying length per drying unit of $$n \times 2.5\text{ mm} = 22 \times 2.5\text{ mm} = 55\text{ mm}, \tag{2}$$

and hence a total drying length of 2×55 mm=110 mm along the medium transport direction x.

In the configuration of FIG. 1, the light-emitting diodes $L_{11}, \ldots, L_{n1}$ of the first drying unit $\mathbf{12}_1$ and the light-emitting diodes $L'_{11}, \ldots, L'_{n1}$ of the second drying unit $\mathbf{12'}_1$ are aligned along a common row in the medium transport direction x.

In other examples, some of the light emitting diodes $L_{11}, \ldots, L_{n1}, L'_{11}, \ldots, L'_{n1}$ may be arranged slightly off-center, for instance within a range of ±20% of a lateral extension of the first or second drying unit (along the transverse direction).

The transverse direction y (orthogonal to the medium transport direction x) corresponds to a width direction of the printer dryer device. Along the transverse direction y, a (possibly large) number k of further first drying units $\mathbf{12}_2, \ldots, \mathbf{12}_k$ and second drying units $\mathbf{12'}_2, \ldots, \mathbf{12'}_k$ may be arranged on the substrate 14. Each of the pairs of first drying units $\mathbf{12}_2, \ldots, \mathbf{12}_k$ and second drying units $\mathbf{12'}_2, \ldots, \mathbf{12'}_k$ may correspond in design and functionality to the first drying unit $\mathbf{12}_1$ and the second drying unit $\mathbf{12'}_1$, respectively, and may each be connected in parallel to the voltage source $V_{cc}$ and driver unit 20 in the same way as the first drying unit $\mathbf{12}_1$ and the second drying unit $\mathbf{12'}_1$ respectively.

Assuming a pitch of 2.5 mm between neighboring drying units and a total width of the drying unit 10 of 1300 mm, $$k = \frac{1300\text{ mm}}{2.5\text{ mm}} = 520 \tag{3}$$

strings of pairs of first drying units $\mathbf{12}_1, \ldots, \mathbf{12}_k$ and second drying units $\mathbf{12'}_1, \ldots, \mathbf{12'}_k$ can be arranged and electrically connected in parallel along the transverse direction y between the voltage source $V_{cc}$ and the driver unit 20.

Other printers can reach even wider sizes of up to 2100 mm or beyond, and hence a correspondingly higher number k of pairs of first and second drying units across the transverse direction y can be provided.

The configuration allows for a quick and efficient drying of printing substances on a printing medium, in particular for fast evaporation drying of water-based inks.

Figure 2:
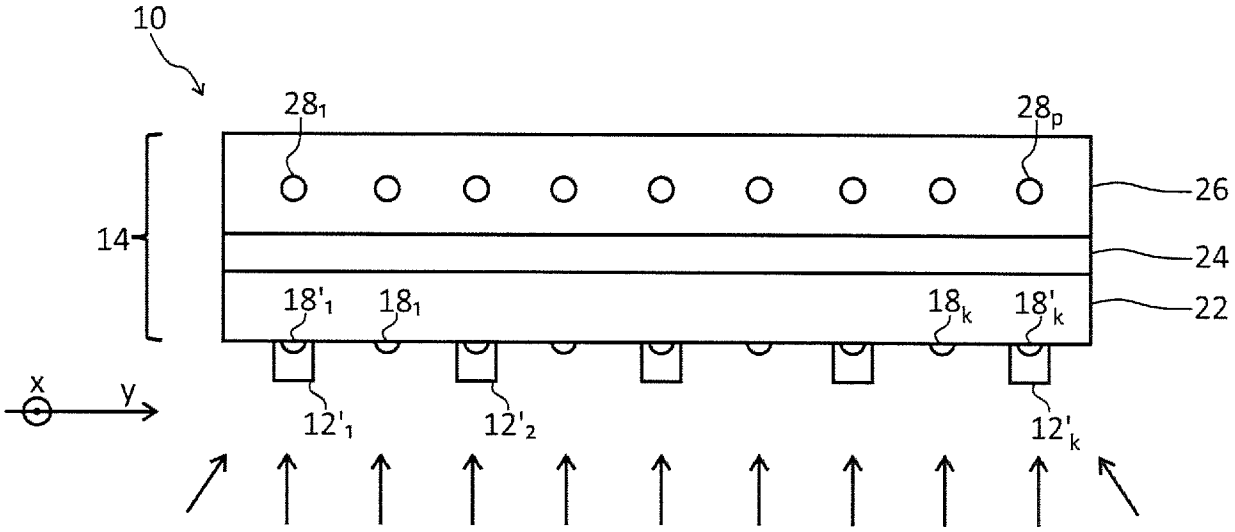
FIG. 2 is a schematic side view of a printer dryer device according to an example.

FIG. 2 shows a printer dryer device 10 in a conceptional schematic side view.

In the configuration of FIG. 2, the second drying units $\mathbf{12'}_1, \ldots, \mathbf{12'}_k$ are shown arranged next to one another along the substrate 14 of the printer dryer device 10. The corresponding first drying units $\mathbf{12}_1, \ldots, \mathbf{12}_k$ are located behind the respective drying units $\mathbf{12'}_1, \ldots, \mathbf{12'}_k$, and hence are not visible in FIG. 2.

The substrate 14 may comprise a printed circuit board 22, and the first drying units $\mathbf{12}_1, \ldots, \mathbf{12}_k$ and the second drying units $\mathbf{12'}_1, \ldots, \mathbf{12'}_k$, first input lines $\mathbf{16}_1, \ldots, \mathbf{16}_k$, second input lines $\mathbf{16'}_1, \ldots, \mathbf{16'}_k$, first output lines $\mathbf{18}_1, \ldots, \mathbf{18}_k$, and second output lines $\mathbf{18'}_1, \ldots, \mathbf{18'}_k$ may be formed on the printed circuit board 22 using "chip on board" (COB) technology.

The printed circuit board 22 may be connected via an adhesive layer 24 to a cooling layer 26. For instance, the cooling layer 26 may be an aluminum layer with a plurality of p pipes $\mathbf{28}_1, \ldots, \mathbf{28}_p$ through which a cooling fluid, such as water, circulates. The cooling layer 28 cools the energy-emitting elements of the first drying units $\mathbf{12}_1, \ldots, \mathbf{12}_k$ and second drying units $\mathbf{12'}_1, \ldots, \mathbf{12'}_k$. At the same time, the cooling layer 26 cools the input lines $\mathbf{16}_1, \ldots, \mathbf{16}_k$, $\mathbf{16'}_1, \ldots, \mathbf{16'}_k$ and output lines $\mathbf{18}_1, \ldots, \mathbf{18}_k$, $\mathbf{18'}_1, \ldots, \mathbf{18'}_k$, which allows the supply lines to be placed in close spatial proximity to the drying units without the risk of overheating.

As further illustrated in FIG. 2, air may be blown in from below or from the sides (indicated by the arrows in FIG. 2) against the surface of the printed circuit board 22 to assist in the cooling.

Figure 3:
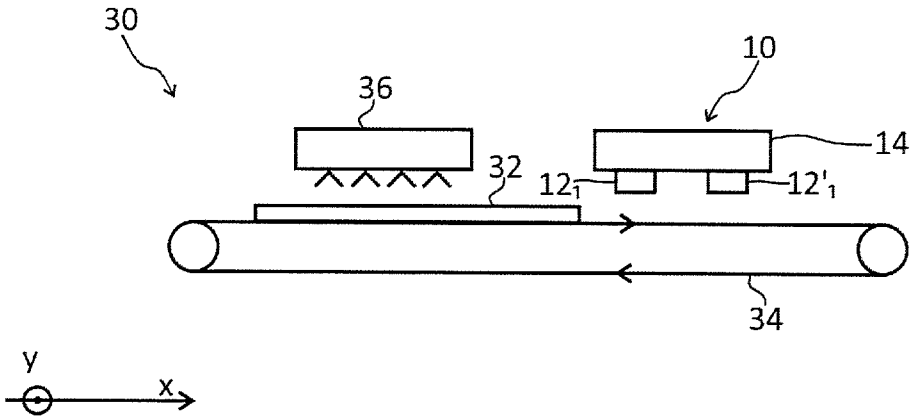
FIG. 3 is a schematic side view of a printing system comprising a printer dryer device according to an example.

FIG. 3 is a schematic illustration of a printing system 30 in which a printer dryer device 10 according to the examples described above with reference to FIGS. 1 and 2 can be employed.

In the configuration of FIG. 3, a printing medium 32, such as a sheet of paper or cardboard, is transported by means of a medium transport unit 34 past a distribution unit 36 and the printer dryer device 10. The distribution unit 36 is located upstream of the printer dryer device 10 in the medium transport direction x, and is adapted to distribute or apply a printing substance, such as water-based ink, on the printing medium 32. The medium transport unit 34 subsequently transports the printing medium 32 to the printer dryer device 10 for drying of the printing substance by means of the first drying unit $\mathbf{12}_1$ and the second drying unit $\mathbf{12'}_1$ arranged along a row on the underside of the printer dryer device 10.

In the configuration of FIG. 3, the printing system 30 is a flat-bed printing system. However, the printing system may also transport the printing medium 32 along a curved path, in particular a circular arc. In this case, both the distribution unit 36 and the printer dryer device 10 may be curved accordingly.

The examples described previously with reference to FIGS. 1 to 3 comprise two drying units arranged along a single row in the medium transport direction x. However, the disclosure is not so limited, and likewise applies to configurations with more than two drying units arranged in a row, or slightly off-centered.

Figure 4:
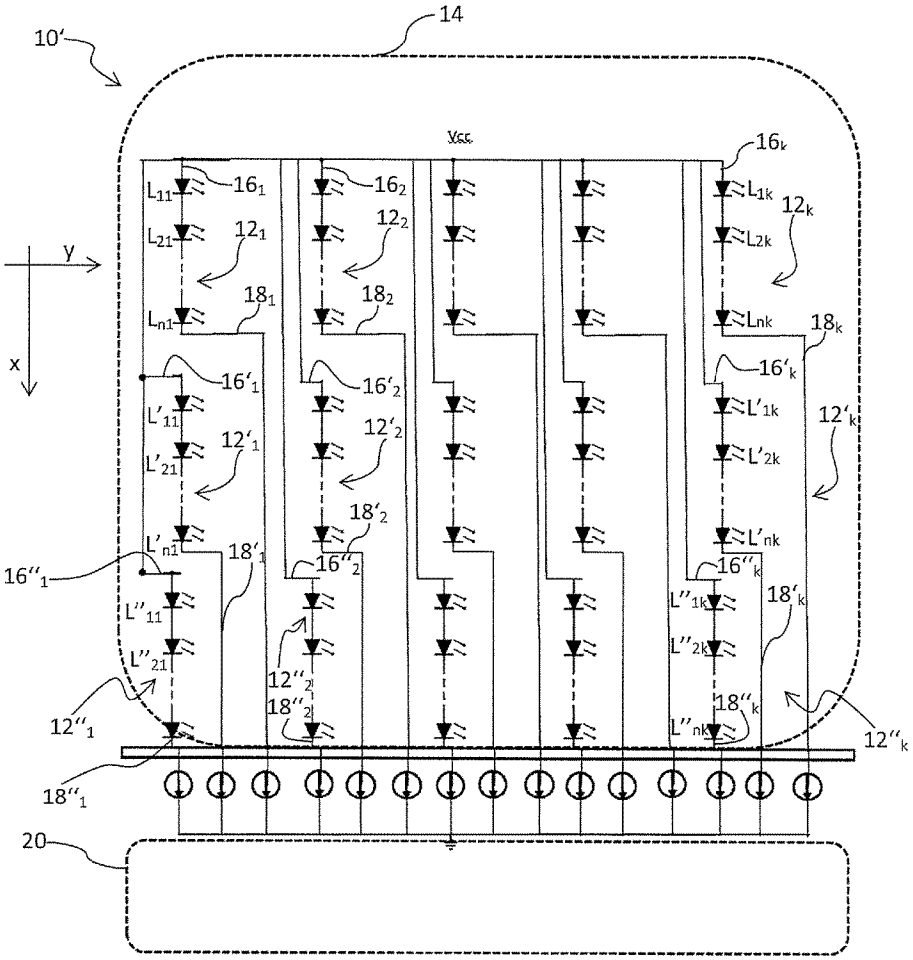
FIG. 4 is a schematic top view of another printer dryer device according to an example.

FIG. 4 is a schematic top view of a printer dryer device 10' that generally corresponds to the printer dryer device 10 described above with reference to FIGS. 1 to 3, but comprises in addition third drying units $\mathbf{12''}_1, \ldots, \mathbf{12''}_k$ aligned with the respective first drying units $\mathbf{12}_1, \ldots, \mathbf{12}_k$ and second drying units $\mathbf{12'}_1, \ldots, \mathbf{12'}_k$, respectively in the medium transport direction x and electrically connected in parallel to the first drying units $\mathbf{12'}_1, \ldots, \mathbf{12}_k$ and second drying units $\mathbf{12'}_1, \ldots, \mathbf{12'}_k$.

The third drying units $\mathbf{12''}_1, \ldots, \mathbf{12''}_k$ may correspond in design and functionality to the first drying units $\mathbf{12}_1, \ldots, \mathbf{12}_k$ and second drying units $\mathbf{12'}_1, \ldots, \mathbf{12'}_k$, and hence reference is made to the above description.

As can be further taken from FIG. 4, the third drying units $\mathbf{12''}_1, \ldots, \mathbf{12''}_k$ are connected to the common voltage source $V_{cc}$ by means of respective third input lines $\mathbf{16''}_1, \ldots, \mathbf{16''}_k$, and are further connected to the driver unit 20 by means of respective third output lines $18''_1, \ldots, 18''_k$. They hence establish a series connection of light-emitting diodes that is not connected in series to the light-emitting diodes of either the first drying units $12_1, \ldots, 12_k$ or the second drying units $12'_1, \ldots, 12'_k$.

Assuming again a pitch of 2.5 mm between neighboring light-emitting diodes in the medium transport direction x, an operating voltage of 3.5 V for each light-emitting diode, and a maximum operational voltage of 80 V, the total drying length along the medium transport direction x can be extended to 3×55 mm=165 mm.

Figure 5:
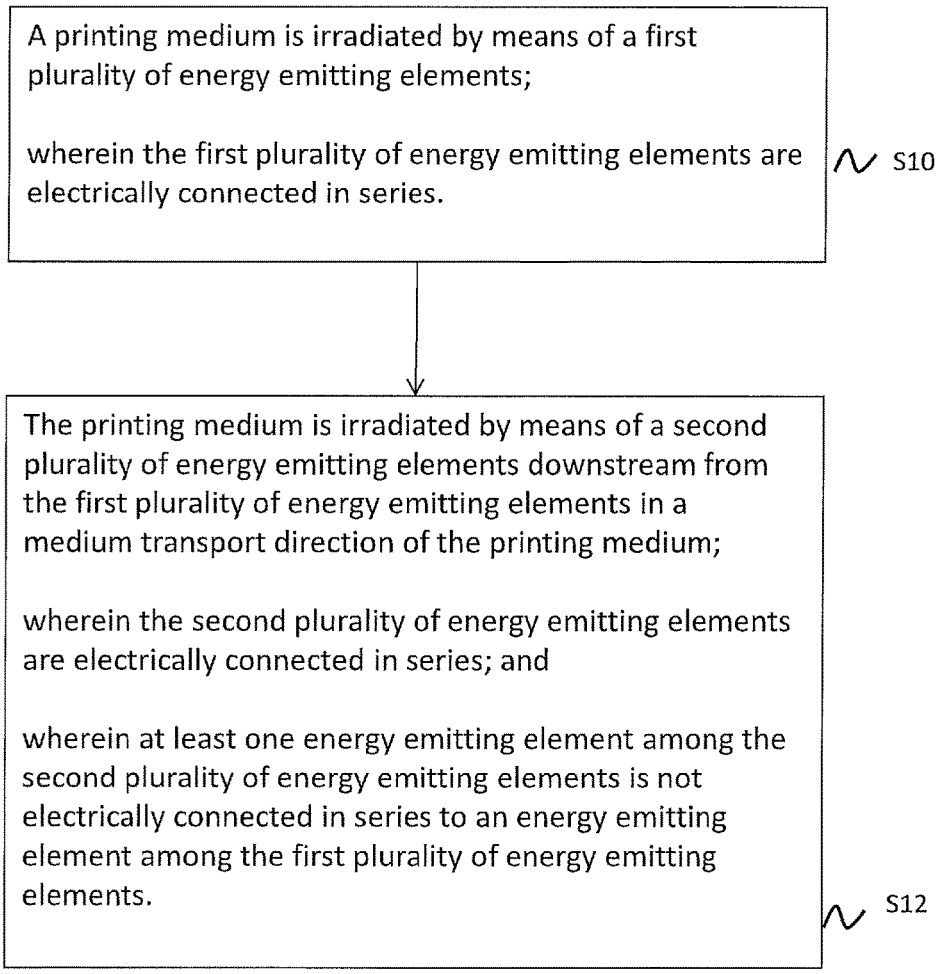
FIG. 5 is a flow diagram illustrating a method for drying a printing substance according to an example.

FIG. 5 is a schematic flow diagram of a method for drying a printing substance on a printing medium.

In a block S10, the printing medium is irradiated by means of a first plurality of energy-emitting elements, wherein the first plurality of energy-emitting elements are electrically connected in series.

In a block S12, the printing medium is irradiated by means of a second plurality of energy-emitting elements downstream of the first plurality of energy-emitting elements in the medium transport direction of the printing medium, and the second plurality of energy-emitting elements are electrically connected in series.

At least one energy-emitting element among the second plurality of energy-emitting elements is not electrically connected in series to an energy-emitting element among the first plurality of energy-emitting elements.

A printer dryer device according to an example comprises a first drying unit, wherein the first drying unit comprises a first plurality of energy-emitting elements to dry a printing substance on a printing medium, wherein the first plurality of energy-emitting elements are electrically connected in series in the first drying unit. The printer dryer device further comprises a second drying unit, wherein the second drying unit comprises a second plurality of energy-emitting elements to dry the printing substance on the printing medium, wherein the second drying unit is arranged downstream from the first drying unit in a medium transport direction of the printing medium. The second plurality of energy-emitting elements are electrically connected in series in the second drying unit, wherein at least one energy-emitting element among the second plurality of energy-emitting elements is not electrically connected in series to an energy-emitting element among the first plurality of energy-emitting elements.

The printing medium may be any medium suitable to be printed, including paper, cardboard, plastic, glass, or ceramics.

In an example, the second drying unit may be aligned with the first drying unit alongside the medium transport direction of the printing medium.

In another example, the first plurality of energy-emitting elements may be arranged along a first lengthwise direction along the medium transport direction, wherein the second plurality of energy-emitting elements may be arranged along a second lengthwise direction along the medium transport direction, wherein the second lengthwise direction may be parallel to the first lengthwise direction and/or wherein the second lengthwise direction may be aligned with the first lengthwise direction.

An alignment of the first and second lengthwise directions may refer to an alignment in a transverse direction, i.e., in a direction orthogonal to the medium transport direction.

In an example, the second lengthwise direction may coincide with the first lengthwise direction.

In another example, the second lengthwise direction may differ from the first lengthwise direction in a transverse or orthogonal direction by less than 20% of a lateral extension of the second drying unit, and in particular by less than 10%.

A lateral extension of the second drying unit may refer to a spatial extension of the second drying unit in a transverse direction, i.e., in a direction perpendicular to the medium transport direction.

In an example, none of the energy-emitting elements in the second plurality of energy-emitting elements is electrically connected in series to any of the energy-emitting elements in the first plurality of energy-emitting elements.

In an example, the first drying unit and the second drying unit may be electrically independent and uncoupled.

In an example, the first dying unit and the second drying unit may be electrically connected in parallel, in particular connected in parallel between a common voltage source and a driver unit.

This may allow to reduce the total voltage drop across the plurality of energy-emitting elements in the series connections of the first and second drying units. At the same time, the printer dryer device may dry the printing substance across an extended length along the medium transport direction, corresponding to the combined length of the first and second drying units.

The printer dryer device may further comprise a substrate on which the first drying unit and the second drying unit are formed, wherein the substrate may be a cooled substrate, in particular a fluid-cooled substrate.

A cooling fluid for cooling the substrate may be a gas or a liquid, and may in particular comprise water.

In an example, the substrate comprises a printed circuit board.

The first plurality of energy-emitting elements and the second plurality of energy-emitting elements as well as wiring and voltage supply for the first drying unit and the second drying unit may be printed on the printed circuit board using semiconductor fabrication techniques.

In an example, the printer dryer device comprises a first set of supply lines electrically supplying the first drying unit, and a second set of supply lines electrically supplying the second drying unit. The second set of supply lines may be different from the first set of supply lines.

The first and second sets of supply lines may be formed on the cooled substrate, and may be cooled by means of the cooling fluid.

In an example, the first set of supply lines comprises a first input line and a first output line, wherein the first input line is connected to a first energy-emitting element at a first end of the first plurality of energy-emitting elements connected in series, and the first output line is connected to a second energy-emitting element at a second end of the first plurality of energy-emitting elements connected in series, wherein the second end is opposite from the first end.

The second set of supply lines may comprise a second input line and a second output line, wherein the second input line is connected to a first energy-emitting element at a first end of the second plurality of energy-emitting elements connected in series, and the second output line is connected to a second energy-emitting element at a second end of the second plurality of energy-emitting elements connected in series, wherein the second end is opposite from the first end.

The second output line may be different from the first output line, and in particular electrically non-connected to the first output line. The second input line may be different from the first input line, and in particular electrically non-connected to the first input line.

The printing substance may be a printing fluid, in particular a printing ink.

In an example, the first plurality of energy-emitting elements are for drying the printing substance on the printing medium by evaporation drying; and/or the second plurality of energy-emitting elements are for drying the printing substance on the printing medium by means of evaporation drying.

The first plurality of energy-emitting elements may comprise light-emitting diodes (LEDs), and in particular ultraviolet light (UV) emitting diodes.

The second plurality of energy-emitting elements may likewise comprise light-emitting diodes (LEDs), and in particular ultraviolet light (UV) emitting diodes.

The first drying unit and/or the second drying unit may comprise at least 15 energy-emitting elements electrically connected in series, and in particular at least 20 energy-emitting elements electrically connected in series.

In an example, the first plurality of energy-emitting elements are arranged geometrically along a first row in the first drying unit. The first row may define the first lengthwise direction.

Similarly, the second plurality of energy-emitting elements may be arranged geometrically along a second row in the first drying unit. The second row may define the second lengthwise direction.

In an example, the first row and/or the second row each comprises at least 15 energy-emitting elements electrically connected in series, and in particular at least 20 energy-emitting elements electrically connected in series.

Examples of printer dryer devices may comprise more than two drying units arranged along the medium transport direction, such as three or four drying units.

Apart from their positioning in the printer dryer device, these further drying units may be similar or identical in technical design and functionality to the first and second drying units described above. Each further drying unit relates to its predecessor along the medium transport direction as the second drying unit described above relates to the first drying unit.

In an example, the printer dryer device comprises a third drying unit, wherein the third drying unit comprises a third plurality of energy-emitting elements to dry the printing substance on the printing medium; wherein the third drying unit is arranged downstream from the second drying unit in the medium transport direction of the printing medium. The third plurality of energy-emitting elements may be electrically connected in series in the third drying unit, wherein at least one energy-emitting element among the third plurality of energy-emitting elements is not electrically connected in series to an energy-emitting element among the first plurality of energy-emitting elements, nor among the second plurality of energy-emitting elements.

In an example, the third drying unit is aligned with the first drying unit and/or the second drying unit alongside the medium transport direction of the printing medium.

The third plurality of energy-emitting elements may be arranged along a third lengthwise direction along the medium transport direction, wherein the third lengthwise direction is parallel to the first lengthwise direction and/or the second lengthwise direction.

In an example, the third plurality of energy-emitting elements may be arranged along a third lengthwise direction along the medium transport direction, wherein the third lengthwise direction is aligned with the first lengthwise direction and/or with the second lengthwise direction.

The third lengthwise direction may coincide with the first lengthwise direction and/or with the second lengthwise direction.

In an example, the third lengthwise direction differs from the first lengthwise direction and/or from the second lengthwise direction by less than 20% of a lateral extension of the third drying unit, and in particular by less than 10%.

In an example, none of the energy-emitting elements in the third plurality of energy-emitting elements is electrically connected in series to any of the energy-emitting elements in the first plurality of energy-emitting elements nor in the second plurality of energy-emitting elements.

The disclosure further relates to a printing system for printing the printing substance on the printing medium moving along the medium transport direction, the printing system comprising a printer dryer device with some or all of the features described above.

The printing system may further comprise a distribution unit to distribute the printing substance on the printing medium, wherein the printer dryer device is located downstream from the distribution unit in the medium transport direction of the printing medium.

The disclosure further relates to a method for drying a printing substance on a printing medium, comprising irradiating the printing medium by means of a first plurality of energy-emitting elements, and irradiating the printing medium by means of a second plurality of energy-emitting elements downstream from the first plurality of energy-emitting elements in a medium transport direction of the printing medium, wherein the first plurality of energy-emitting elements are electrically connected in series, wherein the second plurality of energy-emitting elements are electrically connected in series, and wherein at least one energy-emitting element among the second plurality of energy-emitting elements is not electrically connected in series to an energy-emitting element among the first plurality of energy-emitting elements.

In an example, irradiating the printing medium by means of the first plurality of energy-emitting elements and/or by means of the second plurality of energy-emitting elements is evaporation drying.

In a further example, the method further comprises irradiating the printing medium by means of a third plurality of energy-emitting elements downstream from the second plurality of energy-emitting elements in the medium transport direction of the printing medium, wherein the third plurality of energy-emitting elements are electrically connected in series, and wherein at least one energy-emitting element among the third plurality of energy-emitting elements is not electrically connected in series to at least one energy-emitting element among the first plurality of energy-emitting elements nor among the second plurality of energy-emitting elements.

The description of the examples and the Figures merely serve to illustrate the disclosure, but should not be understood to imply any limitation. The scope of the disclosure is to be determined from the appended claims.

The invention claimed is:

1. A printer dryer device, comprising:

a first drying unit, wherein the first drying unit comprises a first plurality of energy emitting elements to dry a printing substance on a printing medium;

wherein the first plurality of energy emitting elements are electrically connected in series in the first drying unit; and a second drying unit, wherein the second drying unit comprises a second plurality of energy emitting elements to dry the printing substance on the printing medium;

wherein the second drying unit is arranged downstream from the first drying unit in a medium transport direction of the printing medium;

wherein the second plurality of energy emitting elements are electrically connected in series in the second drying unit; and wherein at least one energy emitting element among the second plurality of energy emitting elements is not electrically connected in series to an energy emitting element among the first plurality of energy emitting elements.

2. The printer dryer device according to claim 1, wherein the second drying unit is aligned with the first drying unit alongside the medium transport direction of the printing medium.

3. The printer dryer device according to claim 1 wherein the first plurality of energy emitting elements are arranged along a first lengthwise direction along the medium transport direction, and wherein the second plurality of energy emitting elements are arranged along a second lengthwise direction along the medium transport direction, wherein the second lengthwise direction is parallel to the first lengthwise direction and/or wherein the second lengthwise direction is aligned with the first lengthwise direction.

4. The printer dryer device according to claim 3, wherein the second lengthwise direction differs from the first lengthwise direction by less than 20% of a lateral extension of the second drying unit.

5. The printer dryer device according to claim 1, further comprising a substrate on which the first drying unit and the second drying unit are formed, wherein the substrate is a cooled substrate.

6. The printer dryer device according to claim 1, further comprising a first set of supply lines electrically supplying the first drying unit, and a second set of supply lines electrically supplying the second drying unit, wherein the second set of supply lines is different from the first set of supply lines.

7. The printer dryer device according to claim 6, wherein the first set of supply lines comprises a first input line and a first output line, wherein the first input line is connected to a first energy emitting element at a first end of the first plurality of energy emitting elements connected in series, and the first output line is connected to a second energy emitting element at a second end of the first plurality of energy emitting elements connected in series, wherein the second end is opposite from the first end.

8. The printer dryer device according to claim 1, wherein the first plurality of energy emitting elements are to dry the printing substance on the printing medium by evaporation drying; and/or wherein the second plurality of energy emitting elements are to dry the printing substance on the printing medium by evaporation drying.

9. The printer dryer device according to claim 1, wherein the first plurality of energy emitting elements comprise light emitting diodes, and/or wherein the second plurality of energy emitting elements comprise light emitting diodes.

10. The printer dryer device according to claim 1, wherein the first drying unit and/or the second drying unit comprises at least 15 energy emitting elements electrically connected in series.

11. The printer dryer device according to claim 1, further comprising:

a third drying unit, wherein the third drying unit comprises a third plurality of energy emitting elements to dry the printing substance on the printing medium;

wherein the third drying unit is arranged downstream from the second drying unit in the medium transport direction of the printing medium;

wherein the third plurality of energy emitting elements are electrically connected in series in the third drying unit; and wherein at least one energy emitting element among the third plurality of energy emitting elements is not electrically connected in series to an energy emitting element among the first plurality of energy emitting elements, nor among the second plurality of energy emitting elements.

12. A printing system for printing the printing substance on the printing medium moving along the medium transport direction, the printing system comprising a printer dryer device according to claim 1.

13. A method for drying a printing substance on a printing medium, comprising:

irradiating the printing medium by means of a first plurality of energy emitting elements;

irradiating the printing medium by means of a second plurality of energy emitting elements downstream from the first plurality of energy emitting elements in a medium transport direction of the printing medium;

wherein the first plurality of energy emitting elements are electrically connected in series;

wherein the second plurality of energy emitting elements are electrically connected in series; and wherein at least one energy emitting element among the second plurality of energy emitting elements is not electrically connected in series to an energy emitting element among the first plurality of energy emitting elements.

14. The method according to claim 13, wherein the irradiating the printing medium by means of the first plurality of energy emitting elements and/or by means of the second plurality of energy emitting elements is evaporation drying.

15. The method according to claim 13 further comprising:

irradiating the printing medium by means of a third plurality of energy emitting elements downstream from the second plurality of energy emitting elements in the medium transport direction of the printing medium;

wherein the third plurality of energy emitting elements are electrically connected in series; and wherein at least one energy emitting element among the third plurality of energy emitting elements is not electrically connected in series to at least one energy emitting element among the first plurality of energy emitting elements nor among the second plurality of energy emitting elements.

* * * * *